US011046403B2

(12) United States Patent
Meyer et al.

(10) Patent No.: US 11,046,403 B2
(45) Date of Patent: Jun. 29, 2021

(54) UNDERWATER BODY HAVING A VARIABLE VOLUME AND METHOD FOR OPERATING SUCH AN UNDERWATER BODY

(71) Applicant: ATLAS ELEKTRONIK GMBH, Bremen (DE)

(72) Inventors: Dennis Meyer, Ganderkesee (DE); Detlef Lambertus, Scharmbeck (DE)

(73) Assignee: ATLAS ELEKTRONIK GMBH, Bermen (DE)

( * ) Notice: Subject to any disclaimer, the term of this patent is extended or adjusted under 35 U.S.C. 154(b) by 20 days.

(21) Appl. No.: 16/628,704

(22) PCT Filed: Jul. 9, 2018

(86) PCT No.: PCT/EP2018/068489
§ 371 (c)(1),
(2) Date: Jan. 6, 2020

(87) PCT Pub. No.: WO2019/011831
PCT Pub. Date: Jan. 17, 2019

(65) Prior Publication Data

US 2020/0189705 A1 Jun. 18, 2020

(30) Foreign Application Priority Data

Jul. 12, 2017 (DE) ..... 10 2017 115 601.1

(51) Int. Cl.
*B63G 8/24* (2006.01)
*B63G 8/00* (2006.01)
(Continued)

(52) U.S. Cl.
CPC ..... *B63G 8/24* (2013.01); *B63B 21/00* (2013.01); *B63B 22/00* (2013.01); *B63G 8/001* (2013.01);
(Continued)

(58) Field of Classification Search
CPC ..... B63B 22/00; B63B 21/00; B63B 21/52; B63B 51/00; B63B 51/02; B63C 11/00;
(Continued)

(56) References Cited

U.S. PATENT DOCUMENTS 3,616,775 A 11/1971 Holter
4,271,552 A 6/1981 Sandler
(Continued)

FOREIGN PATENT DOCUMENTS

DE 836 603 C 5/1952
DE 102 06 273 A 8/2003
(Continued)

OTHER PUBLICATIONS

English Translation of International Search Report issued in PCT/EP2018/068489, dated Sep. 19, 2018 (dated Sep. 27, 2018).

*Primary Examiner* — Lars A Olson
(74) *Attorney, Agent, or Firm* — thyssenkrupp North America, LLC

(57) ABSTRACT

An underwater body having a movable component which can be moved into a retracted position and, as a result, increases the volume of the underwater body. In addition, a method is disclosed for operating such an underwater body. An expansion means conducts a fluid into a hollow space. The hollow space is operatively connected to the movable component. When the fluid is conducted into the hollow space, the movable component is moved into the extended position relative to the shell of the underwater body. The fluid in the hollow space hardens. The hardened fluid in the hollow space holds the movable component in the extended position.

17 Claims, 1 Drawing Sheet

(51) Int. Cl.

| | |
|---|---|
| ***B63B 21/00*** | (2006.01) |
| ***B63B 22/00*** | (2006.01) |
| *B63G 8/16* | (2006.01) |
| *B63G 8/22* | (2006.01) |

(52) U.S. Cl.
CPC ..... *B63G 8/16* (2013.01); *B63G 8/22* (2013.01); *B63G 2008/004* (2013.01); *B63G 2008/005* (2013.01)

(58) Field of Classification Search
CPC ..... B63C 11/02; B63C 11/26; B63C 7/00; B63C 7/06; B63G 8/00; B63G 8/001; B63G 8/24
USPC ..... 114/331; 441/30
See application file for complete search history.

(56) References Cited

U.S. PATENT DOCUMENTS

| | | | |
|---|---|---|---|
| 6,254,445 | B1 | 7/2001 | Jones |
| 6,923,105 | B1 | 8/2005 | Gieseke |
| 7,250,568 | B1 | 7/2007 | Dow |
| 2009/0107388 | A1 | 4/2009 | Crowell |

FOREIGN PATENT DOCUMENTS

| | | | |
|---|---|---|---|
| FR | 653846 | A | 3/1929 |
| FR | 2 830 837 | A | 4/2003 |
| FR | 2 943 615 | A | 10/2010 |
| KR | 20000032190 | A | 6/2000 |

UNDERWATER BODY HAVING A VARIABLE VOLUME AND METHOD FOR OPERATING SUCH AN UNDERWATER BODY

CROSS REFERENCE TO RELATED APPLICATIONS

This application is a U.S. National Stage Entry of International Patent Application Serial Number PCT/EP2018/068489, filed Jul. 9, 2018, which claims priority to German Patent Application No. DE 10 2017 115 601.1, filed Jul. 12, 2017, the entire contents of both of which are incorporated herein by reference.

FIELD

The present disclosure generally relates to an underwater body having a movable component which can be moved into an extended position.

BACKGROUND

An underwater body, for example an autonomous unmanned underwater vehicle (AUV) or an underwater mobile body or underwater glider, often has to be transported in an aircraft or watercraft to a site of use if a coast has poor land-side or sea-side accessibility, an entry device is not installed on land or a floating transport platform cannot be used, for example on account of a high swell or rocks. Transporting an underwater body in an aircraft, for example in a helicopter, requires the underwater body to be very compact in shape. Such a compact design of the underwater body, however, creates the disadvantages in the water of insufficient buoyancy and/or unfavorable thickness of the underwater body and, where applicable, unfavorable running characteristics.

Then again, on account of the tight space available in an aircraft, small dimensioning of the underwater body and, in many cases on account of dropping the underwater body from the aircraft, a high thickness of the underwater body is desired for quick immersion into the water.

DE 836603 C shows a small submarine boat, the boat body of which consists of two parts a and b which are inserted into one another. More precisely: The longitudinal wall of part a has two individual walls, between which part b is inserted. Part b can be displaced linearly relative to part a. By part b being moved away from part a, the volume of the small submarine is increased. Two oppositely situated gear racks e each engage in a transmission. The rear ends of the gear racks e are fixedly connected to part b and the two transmissions are fixedly connected to part a. The two drives of the gear racks e are coupled together.

FR 2830837 A1 shows an underwater vehicle (PAP 104—«Poisson Auto Propulse», P), which is guided by a cable (filoguidé) and, for example, is able to destroy mines on the seabed. After use, said underwater vehicle PAP 104 is to come back up to the surface. Consequently, two balloons are received in the folded state (deux ballons replies 1*c*) in a hollow space which is closed by a two-part closure (deux demi carénage 1*c*), cf. FIG. 1. A lock (verrou 1*h*) connects the two closure parts 1*c* together (deux demi carenage 1*c*, fixes entre eux, pour la navigation, par les verrous 1*h*). Each balloon 1*a* is mounted by means of a holding element (contre-forme 1*e*) onto the inner wall of a closure part 1*c*. Each closure part 1*c* is mounted in such a manner on a receiving unit (adapteur 4) that the closure part 1*c* is pivotable about an axis 1*g*.

Each balloon is able to receive, for example, seven liters in the inflated state 1*b*, cf. FIG. 1. From a compressed air source (l'actionneur d'air 6), compressed air can be conducted via a pneumatic connection (distribution de l'air 5) into a balloon 1*a*, 1*b* in order to inflate it. Said source 6 includes, for example, a compressed air bottle 6*a* (bouteille de gaz comprime 6*a*) with a connection body (corps 6*b*) and a displaceable piston (piston coulissant 6*c*) which selectively enables or prevents the outlet of compressed air, cf. FIG. 3.

FR 2943615 A1 shows an underwater body (flotteur) having a hull (fuselage 101) on which two movable cylindrical components (deux appendices mobiles 121, 122 cylindriques) are mounted. Each component 121, 122 can be displaced along an axis 12 which is perpendicular to the longitudinal axis 11 of the hull 101. FIG. 1*a* shows the two components 121, 122 in a retracted position (position rentre), FIG. 1*b* in an extended position (position sorti). If the components 121, 122 are retracted, the underwater body has its minimum volume and when they are extended, it has its maximum volume.

In one design, a double-acting piston-cylinder unit (verin à double effet) can displace a component 121 relative to the hull 101, cf. FIG. 2*a*. The cylinder 151 is mounted on the hull 101 and the piston rod 152 is mounted on the component 121. A ball bearing 161, 162, 163 prevents the ingress of water. In another design, a flexible membrane (membrane souple 181, membrane 182) is mounted between the component 121 and the hull 101, cf. FIG. 2*b* and FIG. 2*c*.

U.S. Pat. No, 6,923,105 B1 describes an underwater mobile body (counter-measure device 10) having a cylindrical shell 12, said mobile body being able to destroy an attacking torpedo. A drive (thrusters 22), a weapon (gun 14) and multiple inflatable chambers (inflatable chambers 24) are mounted on the shell 12. Thanks to said inflatable chambers 24, the center of gravity (center of mass) of the body 10 is close to the center of buoyancy.

Thus a need exists for an underwater body which cause, in a simple manner, the movable component to be moved into the extended position and to remain there.

DETAILED DESCRIPTION

Figure 1:
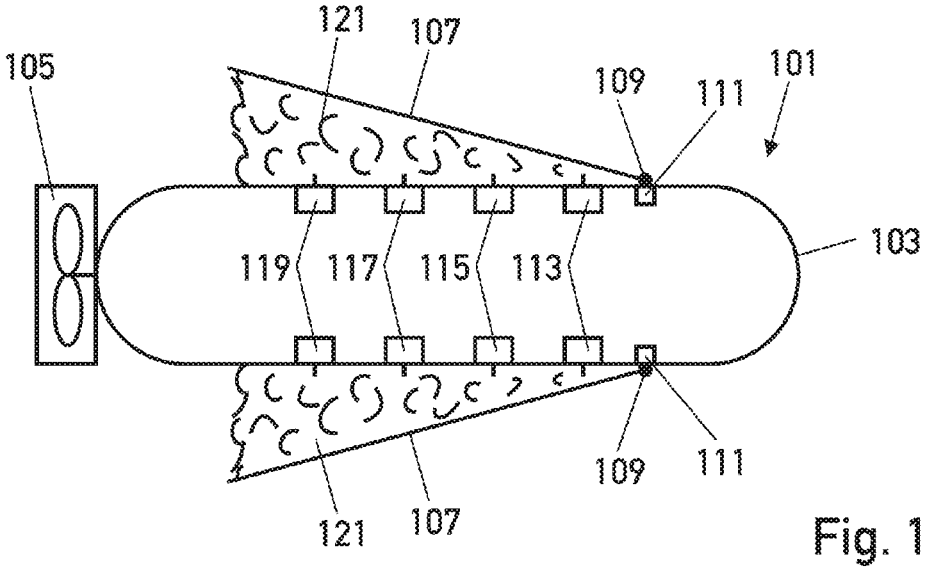
FIG. 1 is a schematic sectional view of an underwater body with a folding shell.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The invention relates to an underwater body having a movable component which can be moved into an extended position and, as a result, increases the volume of the underwater body. In addition, the invention relates to a method for operating such an underwater body.

The underwater body according to the solution includes a shell, a movable component, an expansion means and a hollow space.

The movable component can be moved relative to the shell from a retracted position into an extended position. When the movable component is moved from the retracted into the extended position, the volume of the underwater body is increased.

The expansion means is able to conduct a fluid into the hollow space. The hollow space is operatively connected to the movable component. The operation of conducting fluid into the hollow space causes the movable component to be moved into the extended position.

The fluid in the hollow space hardens. The hardened fluid holds the movable component in the extended position.

The underwater body according to the invention is able to change its volume automatically. If the movable component is in its retracted position, the underwater body thus has a smaller volume. If the movable component is in the extended position, the underwater body thus has a larger volume. As a result, the underwater body meets the two contradictory requirements, namely that the underwater body, on the one hand, is to have as small as possible a volume during transport and, on the other hand, is to have a sufficiently large volume when used in water. It is generally well-known that the buoyancy that a body experiences in the water is equal to the weight of the water displaced by the body. Attempts are made in many applications for the buoyancy of an underwater body to be approximately equal to the weight so that it is not necessary or is only necessary to a certain extent to hold the underwater body at a desired depth of water with the help of an elevator. An elevator only changes the diving depth when the underwater body is moved, whilst a change in volume is also effective on an underwater body which is not currently being moved through the water.

A further advantage of the invention is achieved, in particular, when the underwater body is to be thrown out of an aircraft or a surface craft. The underwater body is to reach a desired water depth once it has contacted the water. As long as the underwater body is in the water and above said water depth, the buoyancy is to be less than the weight so that the underwater body sinks. The invention makes it possible to move the movable component such that it assumes the extended position once it has reached the desired water depth.

It is also possible for the underwater body with the movable component to carry out a predetermined task in the retracted position and then to move the movable component into the extended position. The underwater body can comprise a desired hydrodynamic form when the movable component is in the retracted position. By the movable component being moved into the extended position, the volume of the underwater body is increased in such a manner that the buoyancy is greater than the weight and the underwater body floats to the surface where it can be collected again.

The movable component in the retracted position additionally reduces the risk in many cases of the underwater body being damaged during transport and also when being thrown into the water.

According to the solution, the expansion means conducts a fluid into the hollow space. The hollow space is connected to the movable component. The movable component is moved into the extended position by the fluid being introduced into the hollow space. Said feature avoids the necessity for an actuating drive, for example an electric linear motor or a hydraulic piston-cylinder unit, to move the movable component. Such an actuating drive has to be supplied with power and has to be coupled mechanically with the movable component. The expansion means just needs to be fluidically connected to the hollow space. Such a fluidic connection can be produced in an easier manner in many applications than a mechanical connection between an actuating drive and the movable component. However, it is possible to combine the expansion means according to the solution with an actuating drive for the movable component.

According to the solution, the fluid in the hollow space hardens. The hardened fluid holds the movable component in the extended position. The hardened fluid prevents the pressure of the surrounding water moving the movable component away from the extended position again. The volume of the underwater body and consequently substantially also of the buoyancy remain constant.

Said features result in a particularly simple design in order to hold the movable component in the extended position. The fluid hardens by itself in the hollow space without it being necessary to measure a characteristic of the fluid or to act upon the fluid in the hollow space. It is possible, but thanks to the invention not necessary, for a locking unit to be activated and to hold the movable component in the retracted position. The mechanism to increase the volume of the underwater body consequently requires only a few components which are moved actively and in a controlled manner, in particular a component which triggers the introduction of the fluid into the hollow space. The movable component itself can be designed as a purely passive component.

In one embodiment, the movable component surrounds the hollow space fully or at least in part. The expansion means conducts the liquid fluid therefore into a hollow space in the interior of the movable component. The introduction of fluid results in the movable component being moved into the extended position relative to the shell. The fluid hardens in the interior of the movable component and, as a result, holds the movable component in the extended position. Said design makes a particularly compact construction possible.

In a further embodiment of the invention, the hollow space is connected to the movable component via a piston-cylinder unit. The hollow space is formed in a chamber of the piston-cylinder unit. The expansion means therefore conducts the fluid into said chamber, the fluid in the chamber displaces the piston, the displacement of the piston displaces the movable component into the extended position and the fluid hardens in said chamber. Said design makes it possible to arrange the further component remotely in space from the hollow space for the fluid. The further component does not necessarily need to have a hollow space. Said design makes it easier to design the movable component and to adapt it to the predetermined requirements, for example to a desired hydrodynamic form of the underwater body.

In one design, a flat element is mounted on the outside of the shell of the underwater body. The flat element is associated with the movable component and can be pivoted relative to the shell. By the flat element being pivoted away from the shell, the flat element is moved into an extended position and the volume of the underwater body is increased. The hollow space is formed between the flat element and the outside of the shell. Said design makes it easier to produce the shell of the underwater body from one single piece and/or to design it such that the shell can withstand a predefined water pressure. The space in the interior of the shell is available entirely for further components of the underwater body.

In one embodiment, the flat element surrounds the hollow space fully. In another design, the flat element only surrounds the hollow space in part in the extended position. The hardened fluid in the hollow space comes into contact with the surrounding area, for example with the surrounding water.

In one design, the shell of the underwater body extends along a longitudinal axis. The movable component can be displaced relative to the shell along the longitudinal axis, that is to say in a direction of movement parallel to the longitudinal axis. The movable component can form a segment of the shell. It is possible for the movable component to overlap in a telescopic manner with the shell or the rest of the shell in the retracted position. A flexible seal can be arranged between the movable component and the shell or the rest of the shell.

By the movable component being displaced into the extended position along the longitudinal axis, the length and the volume of the underwater body are increased. Said design makes it possible for the diameter or more generally the dimension of the underwater body in a plane perpendicular to the longitudinal axis to remain constant, irrespective of the position of the movable component. The hydrodynamic characteristics of the underwater body are not modified essentially when the movable component is moved into the extended position.

The movable component can be arranged, in particular, at the stern or at the bow of the shell of the underwater body. It is also possible for the movable component to be moved into the extended position in a direction perpendicular to the or at an angle to the longitudinal axis.

The expansion means is arranged in a preferred manner in the interior of the shell and in one design outside the movable component. The shell protects the expansion means from environmental influences. When the expansion means is arranged outside the movable component, it is not entrained when the movable component is moved relative to the shell. As a result, only a small mass needs to be moved.

The fluid is in a liquid or gaseous state when it flows into the hollow space and hardens in the hollow space. In one design the fluid is completely present on board the underwater body. In another design, a substance is conducted into the hollow space on board the underwater body. The operation where the fluid in the hollow space hardens is brought about at least in part as a result of surrounding water being conducted into the hollow space. The water in the hollow space causes the substance in the hollow space to harden. The fluid in the hollow space hardens for example by a chemical process or by being heated.

In one design, the fluid is an assembly foam and/or includes polyurethane. It is possible to use an assembly foam which is also usable for sealing buildings. Said design saves it being necessary to produce a special fluid. Rather, commercially available assembly foam can be used. The expansion means includes at least one container, for example a cartridge, with the assembly foam. By an opening being opened in said or any cartridge, the assembly foam leaves the cartridge and is conducted into the hollow space. The expansion means preferably includes multiple cartridges so that even if one cartridge fails there is still sufficient fluid available. The fluid is preferably held in a liquid state at an overpressure in the or each cartridge. In a preferred manner, the or each cartridge is a single-use container for the fluid.

In one design, at least one container is produced beforehand with the fluid and is moved into the underwater body. In another design, the fluid or at least one component of the fluid is generated in the underwater body itself, for example by means of a chemical process.

After hardening, the fluid in the hollow space is mechanically stable. At least prior to hardening, the fluid includes, for example, isocyanate and polyalcohol in an aerosol mixture. As soon as the fluid has left the container and has been admitted into the hollow space, the fluid foams and reacts with the moisture in the air or with the moisture on the inside walls of the hollow space. It is also possible for the liquid fluid in the container to include two different components which react with one another in the hollow space, the one component functioning as a cross-linking agent and or as a hardener. Said two components can be mounted in two different containers and only react together in the hollow space.

Fluid is preferably admitted into the hollow space at the same time via multiple inlets. Said design leads to a uniform distribution of the fluid in the hollow space compared to a design where the fluid only flows into the hollow space through one single inlet.

According to the solution, the movable component is moved as a result into the extended position where the expansion means conducts the fluid into the hollow space. In one design, an actuating drive additionally moves the movable component into the extended position relative to the shell. The combination of said two mechanisms in order to move the movable component saves time and causes redundancy. If the one mechanism fails, in a preferred manner the other mechanism thus brings about the desired volume increase on its own.

In one design, a locking unit can be moved from a locking state into a release state. The locking unit includes, for example, a flap element and/or a wedge element. In the locking state, the locking units locks the movable component. In the release state, the locking unit makes it possible for the movable component to be moved relative to the shell. The locking unit in the locking state prevents an unwanted movement of the movable component relative to the shell. It is possible for the actuating drive to function additionally as the locking unit or for a locking unit to be used in addition to the actuating drive.

In a continuation of said design, the locking unit holds the movable component in the retracted position. As a result, the locking unit prevents, in particular, the movable component being moved out of the retracted position unintentionally during transport of the underwater body. This ensures that the underwater body retains its smallest possible volume during transport. It is also possible for the locking unit to hold the movable component in an extended position.

In one design, an actuating member transfers the locking unit from the locking state into the release state. In another design, the introduction of fluid into the hollow space causes the locking unit to be transferred into the release state, for example by the pressure of the fluid in the hollow space forcing the locking unit into the release state or also by the locking unit breaking so that it no longer exerts a locking function.

In one design, a fluid sensor on board the underwater body measures how much fluid is conducted into the hollow space. Said fluid sensor measures a measurement for the amount of fluid, for example a time interval or a pressure which the fluid exerts on the outer shell or, in the event of a movable component with a flexible outer shell, a measurement for the pressure which the fluid exerts on the outer shell. The expansion means conducts fluid into the hollow space until a predetermined amount of fluid is in the hollow space. The expansion means works independently of signals from the fluid sensor. As soon as the predetermined amount of fluid is in the hollow body, the expansion means terminates the operation conducting fluid into the hollow space. Said design is a possibility to move the movable component into a certain extended position and consequently to obtain a certain volume of the underwater body.

According to the solution, the movable component can be moved from the retracted into the extended position. In this connection, the movable component executes a movement relative to the shell. In one design, a stop element delimits the possible movement of the movable component away from the shell. Said stop element consequently defines the extended position of the movable component and accordingly the maximum achievable volume of the underwater body. Said design makes it superfluous to monitor the fluid flowing into the hollow space and to control or regulate the enclosed amount of fluid in order to obtain a desired extended position of the movable component and consequently a desired volume of the underwater body. It is sufficient to introduce at least one predetermined amount of fluid into the hollow space and to allow it to harden there. The stop element delimits the movement of the movable component, even if the entire amount of fluid is conducted into the hollow space. Said design further reduces the number of actively moved components necessary and/or of underwater body sensors.

In a continuation of said design, the stop element can be fixed in a position relative to the shell, said position being selected from multiple possible positions. The operation to fix the stop element in a selected position can be carried out prior to the use of the underwater body. By a certain position being selected and the stop element being fixed in said selected position, a volume of multiple volumes of the underwater body can be obtained with the movable component in an extended position. Said design leads to a particularly simple mechanism for obtaining a desired volume and saves on an actuatable actuating drive which holds the movable component in a desired position, as well as a fluid sensor. The designs with the stop element and with an actuating drive or the fluid sensor can also be combined together.

In one design, the movable component is moved into the extended position once the underwater body has been thrown out of, for example, an aircraft or a surface craft and then a predetermined interval has passed. In one design, the underwater body activates the expansion means automatically and as a result automatically triggers the step of conducting fluid into the hollow space as a reaction to the detection of an event. A sensor which automatically detects said event is present on board the underwater body. The event can be, for example, that the underwater body is situated in the water or that the underwater body is situated at a water depth that is greater than or equal to a predetermined water depth. The sensor measures, for example, the pressure of the surrounding water. It is possible for the expansion means to be activated after the sensor has detected the event and a predetermined interval has passed. It is also possible for a time switch to be activated and to detect the event where a predetermined interval has passed since activation of the time switch. The detection of said event triggers the step of activating the expansion means.

The design with the sensor makes it easier to carry out the increase in volume such that the underwater body with the increased volume is held at a certain water depth. If the underwater body itself can measure the current water depth, it is not necessary to predetermine an interval and the correct point in time for increasing the volume depends to a lesser extent on the environmental conditions such as water currents and water temperature and saline content.

In one design, the movable component is a rigid component or has at least a rigid outside shell. As a result, the movable component is only deformed insignificantly when the underwater body is exposed to the water pressure underwater. The underwater body retains its hydrodynamic form substantially also at different diving depths.

In another design, the movable component has a flexible outer shell, for example in the manner of a balloon or a windsock. Said design makes it possible to mount the flexible component with little space, for example in the interior of the shell, for as long as the flexible component is to remain in the retracted state. In order to move the movable component into the extended position, the fluid is conducted into the movable component. The introduced fluid expands the flexible outer shell, as a result increases the volume of the movable component and then hardens in the enlarged movable component. For example, the fluid inflates the flexible outer shell and then hardens in the inflated outer shell.

The underwater body is designed for the purpose of being used underwater and can comprise its own drive or can be towed through the water by another vehicle. The underwater body can be designed for civil and/or for military purposes and can include sensors and/or actuators.

In one design, the underwater body can operate autonomously, i.e. without instructions from the outside. For example, the underwater body is an unmanned autonomous underwater vehicle (AUV) or also a manned submarine. The underwater body automatically triggers the step of the expansion means conducting the fluid into the hollow space.

In another design, the underwater body is designed for the purpose of receiving control commands from a spatially remote platform, for example from a surface ship or an aircraft. The underwater body is, for example, a remotely controlled unmanned underwater vehicle (ROV, remotely operated vehicle), an underwater robot, an underwater glider or an underwater mobile body, for example a torpedo, which is controlled via fiber optic cable. Such a control command causes, for example, the expansion means to conduct the fluid into the hollow space. The control commands are directed to the underwater body wirelessly, in particular via underwater communication or via a cable from the spatially remote platform.

In a possible application, the underwater body is thrown out of an aircraft, for example a helicopter or an airplane, and falls into the water. The aircraft transports the underwater body to a desired site of use. In another possible application, the underwater body is thrown into the water from a platform in the water, for example from a surface ship or a stationary platform in the water. The movable component is in the retracted position, whilst the underwater body is transported by the aircraft or marine craft so that the underwater body has the smallest possible volume during transport. The ejected underwater body sinks in the water. Once the underwater body is fully in the water and, for example, a predetermined water depth has been reached, the movable component is moved into the extended position and the volume of the underwater body in the water is increased so that the buoyancy which acts on the underwater body is also increased.

In one design, the underwater body now has such a volume where the weight of the displaced water is approximately equal to the weight of the underwater body and the underwater body roughly floats in the water. In another design, the weight of the displaced water is greater than the weight of the underwater body so that the underwater body rises to the surface of the water again and can be collected.

The three figures show an underwater body 101, 201, 301 which travels from left to right in a direction of travel.

FIG. 1 shows a first exemplary embodiment of the invention. An underwater body 101 comprises a shell 103. A folding shell 107 is arranged on the outside of the shell 103. The folding shell 107 is segmented and in a preferred manner is arranged extending all around a longitudinal axis of the underwater body 101 and is fastened by means of pivot joints 109 to the shell 103 of the underwater body 101. The pivot joints 109 are connected to an actuating motor 111. A first assembly foam cartridge 113, a second assembly foam cartridge 115, a third assembly foam cartridge 117 and a fourth assembly foam cartridge 119 are situated in the interior of the underwater body 101 in each case on an underside and upper side, therefore there is a total of eight cartridges. A respective outlet of the respective assembly foam cartridges 113, 115, 117 and 119 is guided to the outside through the shell 103 of the underwater body 101 and they are situated between the folding shell 107 and the outside of the shell 103. The cartridges 113 to 119 are associated with the expansion means of the first exemplary embodiment.

In addition, the expansion means includes a component which holds the assembly foam 121 in the cartridges 113 to 119 in the liquid or foam state and as a result prevents the assembly foam 121 from hardening already in a cartridge 113 to 119, which is unwanted. The underwater body 101 comprises a propeller drive 105 at the stern.

Whilst the underwater body 101 is transported, for example, in an aircraft, the folding shell 107 is in a transport position in which the flap 107 abuts directly against the shell 103 of the underwater body. The folding shell 107 is locked in said stowed position by means of a predetermined breaking point. The underwater body 101 is thrown out of the aircraft, not shown, above the planned site of use into the sea or another body of water and is immersed into the water.

The underwater body 101 is automatically transferred from the transport position into a driving position when a predetermined event has occurred. FIG. 1 shows the folding shell 107 in said driving position. Said predetermined event occurs, for example, when a predetermined interval since the ejection from the aircraft has passed. Or a sensor (not shown) of the underwater body 101 detects the event where the underwater body 101 has reached the water and the predetermined event then occurs when a predetermined interval has passed after said detection. Or a depth sensor on-board the underwater body 101 measures the current diving depth of the underwater body 101 sinking in the water and situated in the transport position. As soon as the measured current diving depth matches a predetermined diving depth, the step of transferring the underwater body from the transport position into the driving position is automatically triggered.

The following steps are carried out during the transfer from the transport position into the driving position: The actuating motor 111 releases the pivot joints 109. The four assembly cartridges 113, 115, 117 and 119 are activated. For example, one opening in each cartridge 113 to 119 is opened. As a result, assembly foam 121 is released from the assembly foam cartridges 113, 115, 117 and 119, for example because the liquid assembly foam 121 in the cartridges 113 to 119 was under overpressure. The releasing of the assembly foam 121 causes the predetermined breaking point to break and the lock is freed as a result. The released assembly foam 121 presses against the flap 107. In addition, the actuating motor 111 pivots the folded shell 107 away from the shell 103 of the underwater body 101. As a result of said two effects combined together the flap 107 is moved away from the shell 103 and folded out to its maximum position. A hollow space is formed between the folded-out folding shell 107 and the shell 103. Said hollow space is filled with assembly foam 121. The assembly foam 121 hardens and as a result locks the folding shell 107 permanently. The folding shell 107 now has the form of a truncated cone which surrounds the shell 103. The diameter of the folding shell 107 increases in a direction toward the stern of the underwater body 101 so that a favorable hydrodynamic form continues to be obtained.

Because the folding shell 107 is held permanently in the maximum position, the volume of the underwater body 101 is permanently increased. It is also possible for the folding shell 107 only to be pivoted out to an intermediate position and for the assembly foam 121 to hold the folding shell 107 in said intermediate position. In one design, the position into which the folding shell 107 is to be folded out and locked there is set in advance in a control program. Said position can depend on a desired water depth and/or on a water temperature. In another design, a stop element (not shown) delimits the possible movement of the folding shell 107 away from the shell 103. In a preferred embodiment, said stop element can be fixed in one of multiple possible positions so that a volume selected from multiple possible volumes of the underwater body 101 is obtained.

In a modification, each folding shell 107 is connected respectively to a spring element. Said spring element attempts to hold the folding shell 107 in the transport position, that is to say in the position at which the folding shell 107 abuts against the shell 103 of the underwater body 101. The released assembly foam 121 pivots the folding shell 107 against the spring force of said spring element away from the shell 103. The position which the pivoted-out folding shell 107 reaches depends, on the one hand, on the spring force and, on the other hand, on the amount of assembly foam 121 released. At least one of said two parameters can be set in dependence on the desired water depth and/or the water temperature.

Figure 2:
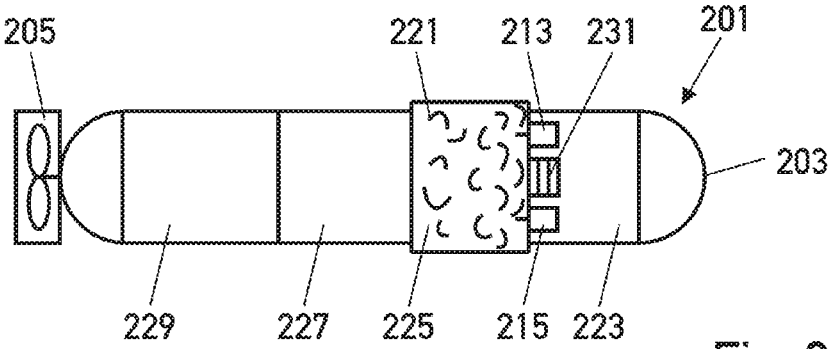
FIG. 2 is a schematic sectional view of an underwater body with a displaceable shell segment in the front region of the underwater body.

FIG. 2 shows a second exemplary embodiment of the invention. The underwater body 201 comprises a shell 203 and a propeller drive 205. The shell 203 of the underwater body 201 includes a sequence with four shell segments, namely when seen in the direction of travel from left to right, a first shell segment 223, a second shell segment 225, a third shell segment 227 and a fourth shell segment 229. A first assembly foam cartridge 213 and a second assembly foam cartridge 215 are fastened to the shell 203 for example to the first shell segment 223. In each case an outlet of the cartridge 213 and 215 leads into the interior of the second shell segment 225. The second shell segment 225 can be displaced relative to the third shell segment 227 along the longitudinal axis of the underwater body 201. An optional linear motor 231 can move the second shell segment 225 relative to the shell 203. A guide device (not shown)

preferably guides the second shell segment 225 in a movement relative to the third shell segment 227.

In the transport position, the second displaceable shell segment 225 is pushed above the third shell segment 227, for example telescopically, such that the second shell segment 225 overlaps in part with the third shell segment 227. The second shell segment 225 abuts in part against the first shell segment 223. Consequently, the underwater body 201 comprises a compact form with the shortest possible length and the smallest possible volume. A flexible seal is preferably arranged between the second shell segment 225 and the third shell segment 227. A flexible seal is also arranged in a preferred manner between the second shell segment 225 and the first shell segment 223. Said flexible seals retain their sealing effect even when the second shell segment 225 is moved.

As soon as the above-described event has occurred, the underwater body 201 is automatically transferred into a driving position. FIG. 2 shows the underwater body 201 in said driving position. The following steps are carried out during the transfer: Assembly foam 221 exits from the first assembly foam cartridge 213 and the second assembly foam cartridge 215. The emerging assembly foam 221 causes the second shell segment 225 to be displaced away from the third shell segment 227. As a result, the length and the volume of the underwater body 201 are increased. In addition, as an option, the linear motor 231 moves the second shell segment 225. It is additionally possible for a gas, for example compressed air, to be admitted into the second shell segment 225 and additionally to contribute to the displacement of the second shell segment 225. By the second shell segment 225 being displaced, a hollow space is formed in the interior of the second shell segment 225. The assembly foam 221 flows into the second shell segment 225 and hardens there. The hardened assembly foam 221 prevents ingress of water into the hollow interior of the shell segment 225.

In one design, the first segment 223 is fixedly connected to the shell segment 225 and is also displaced away from the third shell segment 227. In another design, the diameter of the second shell segment 225 is greater than the diameter of the first shell segment 223. As a result, the volume of the underwater body 201 is also increased when the first shell segment 223 is fixedly connected to the third shell segment 227.

In both designs, the emerging assembly foam 221 hardens in the hollow space generated and, as a result, fixes the displaceable second shell segment 225 relative to the third shell segment 227. The amount by which the volume is increased depends on the amount of assembly foam 221 released, which can be adjusted. In one design, the linear motor 231 and/or a stop element (not shown) delimit the possible movement of the second shell segment 225 away from the third shell segment 227 and, as a result, establish the amount of the volume increase.

Figure 3:
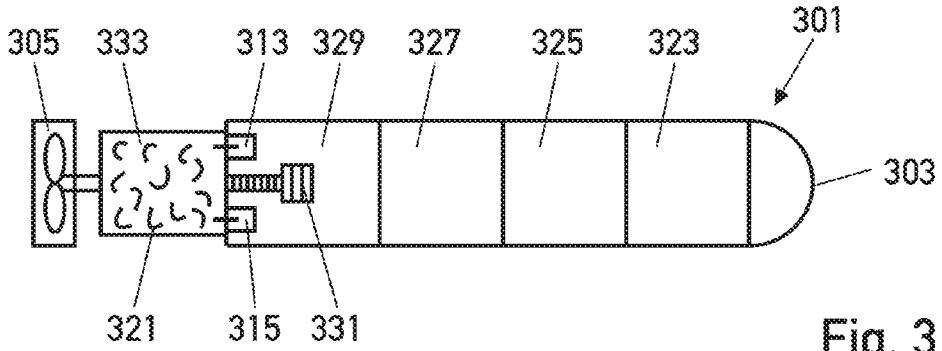
FIG. 3 is a schematic sectional view of an underwater body with a slide-out shell segment and a propeller drive arranged thereon.

FIG. 3 shows a third exemplary embodiment of the invention. The underwater body 301 has a shell 303 which is subdivided into a sequence of five shell segments, namely into a first shell segment 323, a second shell segment 325, a third shell segment 327, a fourth shell segment 329 and a fifth shell segment 333. The fifth shell segment 333 is arranged at the stern of the underwater body 301 and carries the propeller 305. At the bow-side, the fifth shell segment 333 is connected to a first assembly foam cartridge 313 and a second assembly foam cartridge 315. The cartridges 313 and 315 are mounted on the rear wall of the fourth segment 329 and their outlets lead into the fifth shell segment 333. The first four shell segments 323 to 329 are fixedly connected together. The fifth shell segment 333 surrounds a hollow interior and can be displaced rearward relative to the fourth shell segment 329 along the longitudinal axis of the underwater body 301. A guide device preferably guides the fifth shell segment 333 in a movement relative to the fourth shell segment 329.

When the underwater body 301 is in the transport position, the fifth shell segment 333 is inserted into the fourth shell segment 329. A locking wedge, not shown, locks the fifth shell segment 333 in said position. The propeller drive 305 abuts directly against the stern-side end of the fourth shell 329.

FIG. 3 shows the underwater body 301 in the driving position. In order to transfer the underwater body 301 into the driving position, the following steps are carried out: The lock of the fifth shell segment 333 is released. The assembly foam 321 is released from the first assembly foam cartridge 313 and the second assembly foam cartridge 315. The released assembly foam 321 penetrates into the hollow space in the interior of the fifth shell segment 333. The released assembly foam 321, as a result, exerts a pressure on the fifth shell segment 333. As a result of said pressure, the fifth shell 333 including the propeller drive 305 is pushed out of the fourth shell segment 329, away from the fourth shell segment 329. The released assembly foam 321 fills the hollow space in the fifth shell segment 333 entirely or at least in part and hardens. As a result, the fifth shell segment 333 is permanently fixed in the extended position.

In one design, the optional linear motor 331 pushes the fifth shell segment 333 away from the fourth shell segment 329. It is possible additionally for a gas, for example compressed air, to be conducted into the fifth shell segment 333. In one design, the linear motor 331 and/or a drive element (not shown) delimits the linear movement of the fifth shell segment 333 away from the fourth shell segment 329. Once again, the amount of the volume increase can be adjusted by the amount of the released assembly foam 321 and/or the distance over which the linear motor 331 displaces the fifth shell segment 333 being correspondingly adjusted or by the stop element being correspondingly fixed.

LIST OF REFERENCES

101 Underwater body of the first exemplary embodiment
103 Shell of the underwater body 101
105 Propeller drive of the underwater body 101
107 Folding shell with which the pivoting joint 109 is pivotably mounted on the shell 103
109 Pivot joint in which the flap 107 is pivotably mounted on the shell 103
111 Actuating motor, can pivot the folding shell 107
113 First assembly foam cartridge, mounted in the interior of the shell 103
115 Second assembly foam cartridge, mounted in the interior of the shell 103
117 Third assembly foam cartridge, mounted in the interior of the shell 103
119 Fourth assembly foam cartridge, mounted in the interior of the shell 103
121 Assembly foam from the four cartridges 113 to 119
201 Underwater body of the second exemplary embodiment
203 Shell of the underwater body 201
205 Propeller drive of the underwater body 201
213 First assembly foam cartridge, mounted in the first shell 223

215 Second assembly foam cartridge, mounted in the first shell 223
221 Assembly foam from the two cartridges 213 and 215
223 First shell segment of the shell 203
225 Second, displaceable shell segment of the shell 203
227 Third shell segment of the shell 203
229 Fourth shell segment of the shell 203
231 Linear motor for displacing the second shell segment 225
301 Underwater body of the third exemplary embodiment
303 Shell of the underwater body 301
305 Propeller drive of the underwater body 301, mounted on the fifth shell segment 333
313 First assembly foam cartridge, mounted in the fourth shell segment 329
315 Second assembly foam cartridge, mounted in the fourth shell segment 329
321 Assembly foam from the two cartridges 313 and 315
323 First shell segment of the shell 303
325 Second shell segment of the shell 303
327 Third shell segment of the shell 303
329 Fourth shell segment
331 Linear motor for displacing the fifth shell segment 333
333 Fifth, slide-out shell segment, carries the propeller drive 305

What is claimed is:

1. An underwater body comprising:
a shell,
a movable component,
an expansion means, and
a hollow space,
wherein the movable component is movable relative to the shell from a retracted position into an extended position and is operatively connected to the hollow space,
wherein the underwater body with the movable component in the extended position has a greater volume compared to the underwater body with the movable component in the retracted position, and
wherein the expansion means is configured to conduct a fluid into the hollow space and, as a result, of moving the movable component into the extended position,
wherein the underwater body is configured such that when the fluid in the hollow space hardens the hardened fluid holds the movable component in the hollow space in the extended position,
wherein the hollow space is connected to the movable component via a piston cylinder unit and the hollow space is formed in a chamber of the piston cylinder unit.

2. The underwater body of claim 1 wherein the movable component surrounds the hollow space at least in part.

3. The underwater body of claim 1 wherein the movable component includes a flat element mounted so as to be pivotable on the outside of the shell and wherein the hollow space is formed between the flat element and the shell.

4. The underwater body of claim 1 wherein the movable component surrounds the hollow space fully and comprises a flexible outer shell, wherein the introduction of fluid into the hollow space causes the space surrounded by the flexible outer shell to increase in volume.

5. The underwater body of claim 1 wherein the shell extends along a longitudinal axis and the movable component is displaceable along the longitudinal axis relative to the shell, wherein when the movable component is in the extended position the underwater body is longer than when the movable component is in the retracted position.

6. The underwater body of claim 5 wherein the underwater body is configured to move through water in a direction of travel, wherein the movable component is arranged at a stern of the shell.

7. The underwater body of claim 1 wherein the fluid is an assembly foam and the expansion means includes at least one container with the assembly foam, wherein the assembly foam is configured to harden outside the container.

8. The underwater body of claim 1 wherein the expansion means includes an actuating drive configured to move the movable component into the extended position.

9. The underwater body of claim 1 wherein the underwater body includes a locking unit configured to lock the movable component in a locked state and configured to enable the movable component to move relative to the shell in a released state.

10. The underwater body of claim 9 wherein the locking unit locks the movable component in the retracted position in the locked state.

11. The underwater body of claim 1 wherein the underwater body includes a fluid sensor which is configured to measure an amount of fluid conducted into the hollow space and the expansion means is configured to terminate the introduction of fluid into the hollow space when a predefined amount of fluid is conducted into the hollow space.

12. The underwater body of claim 1 wherein the underwater body includes a stop element, wherein the stop element delimits the movement of the movable component into the extended position.

13. The underwater body of claim 12 wherein the stop element is fixable in one of multiple possible positions.

14. The underwater body of claim 1 wherein the underwater body includes a sensor which is configured to detect at least one event comprising:
when the underwater body is situated in water or when the underwater body has reached a predefined water depth in water, and
the underwater body is configured to activate the expansion means automatically as a reaction to the detection of the event.

15. An underwater body comprising:
a shell,
a movable component,
an expansion means, and
a hollow space,
wherein the movable component is movable relative to the shell from a retracted position into an extended position and is operatively connected to the hollow space,
wherein the underwater body with the movable component in the extended position has a greater volume compared to the underwater body with the movable component in the retracted position, and
wherein the expansion means is configured to conduct a fluid into the hollow space and, as a result, of moving the movable component into the extended position,
wherein the underwater body is configured such that when the fluid in the hollow space hardens the hardened fluid holds the movable component in the hollow space in the extended position,
wherein the underwater body includes a locking unit configured to lock the movable component in a locked state and configured to enable the movable component to move relative to the shell in a released state.

16. The underwater body of claim 15 wherein the locking unit locks the movable component in the retracted position in the locked state.

17. An underwater body comprising:

a shell, a movable component, an expansion means, and a hollow space, wherein the movable component is movable relative to the shell from a retracted position into an extended position and is operatively connected to the hollow space, wherein the underwater body with the movable component in the extended position has a greater volume compared to the underwater body with the movable component in the retracted position, and wherein the expansion means is configured to conduct a fluid into the hollow space and, as a result, of moving the movable component into the extended position, wherein the underwater body is configured such that when the fluid in the hollow space hardens the hardened fluid holds the movable component in the hollow space in the extended position, wherein the underwater body includes a stop element, wherein the stop element delimits the movement of the movable component into the extended position, wherein the stop element is fixable in one of multiple possible positions.

* * * * *